United States Patent [19]

Seitz-Gangemi

[11] Patent Number: 4,785,984

[45] Date of Patent: Nov. 22, 1988

[54] ATHLETIC RADIO HOLDER

[76] Inventor: Kimberly Seitz-Gangemi, 40 Whaler La., North Quincy, Mass. 02171

[21] Appl. No.: 51,779

[22] Filed: May 20, 1987

[51] Int. Cl.[4] ..... A45F 3/04

[52] U.S. Cl. ..... 224/259; 224/209

[58] Field of Search ..... 224/209, 214, 215, 259, 224/901, 908, 909, 153, 203

[56] References Cited

U.S. PATENT DOCUMENTS

| | | | |
|---|---|---|---|
| 2,169,080 | 8/1939 | Clark | 224/209 |
| 2,918,920 | 12/1959 | Lutsky | 450/2 |
| 3,152,738 | 10/1964 | Worsfold, Jr. | 224/259 |
| 3,884,403 | 5/1975 | Brewer | 224/259 |

OTHER PUBLICATIONS

Sweatband Radio Holder advertisement, *Women's Sports and Fitness,* May 1987.

*Primary Examiner*—Henry J. Recla
*Assistant Examiner*—Linda J. Sholl
*Attorney, Agent, or Firm*—Wolf, Greenfield & Sacks

[57] ABSTRACT

An elasticized harness capable of being worn on the upper torso of a person for carrying an article such as a radio while walking, jogging, cycling, climbing or during other such fitness activities and the like. A portion of the harness lies flat on the wearer's back between the shoulder blades. A patch of cut-loop material is attached to this flat-lying portion and secures the article to the harness. When the harness is worn, the article is sandwiched between the flat-lying portion of the harness and the wearer's back.

8 Claims, 2 Drawing Sheets

ATHLETIC RADIO HOLDER

BACKGROUND OF THE INVENTION

This invention relates to a device for carrying an article such as a radio while walking, jogging, cycling, climbing or during other fitness activities and the like.

It is desirable to carry a radio, particularly one with headphones when walking, jogging, cycling, climbing or the like. Typically radios or cassette players are hand held, placed in a pocket or secured to a belt when engaging in such athletic activity. The latter two, of course, require that a person's athletic wear have suitable pockets or belts for carrying the radio device. Even where special belts adaptable to any athletic wear are used, it is difficult to position the radio in a comfortable manner.

A recent product employs a headband with a cut loop material patch to which a specially designed lightweight radio is attached. The headband cannot be worn to carry radio devices of "normal" weight. Furthermore, the radio itself weighs about 12 ounces and can cause great discomfort when worn on the head for any extended period of time.

SUMMARY OF THE INVENTION

The invention provides a lightweight, inexpensive device that allows a person to comfortably carry a radio, tape player or the like while engaging in fitness activities such as walking, jogging, cycling, climbing, and the like. The device may be worn above or beneath the athletic wear and any athletic wear is suitable for use with the device.

The invention is an elasticized harness capable of being worn on the upper torso of a person that sandwiches the radio device between the harness and the person's back between the shoulder blades. In particular, the harness is preferably a pair of elasticized members of equal length attached in diagonal relation so as to overlap along a region defining a flat-lying portion. When the harness is worn, this flat-lying portion is positioned against the wearer's back between the shoulder blades. A patch of Velcro®-like material is attached to this flat lying overlapping portion. A complementary Velcro®-like patch is secured to the article to be carried. The article is then attached to the harness via these Velcro®-like patches with the article sandwiched between the flat lying portion of the harness and the wearer's back.

DETAILED DESCRIPTION OF DRAWINGS

Figure 1:
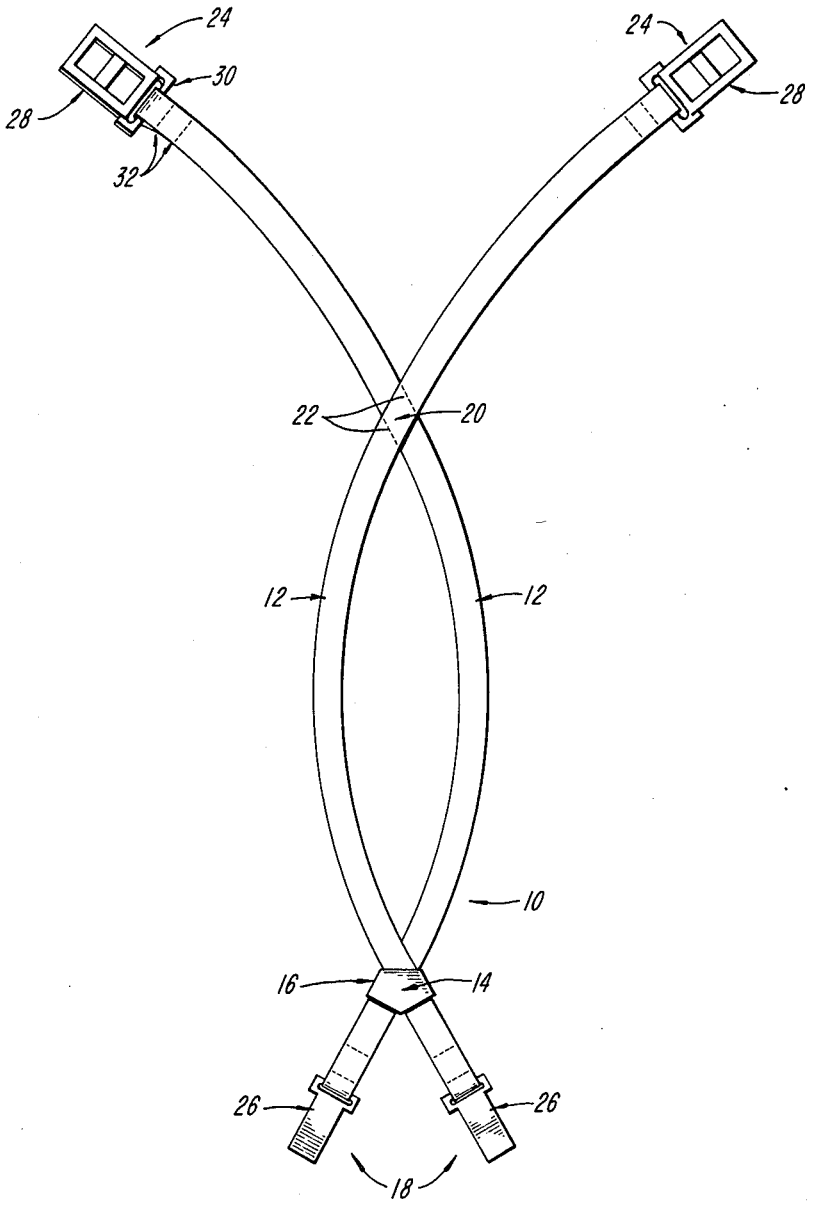
FIG. 1 shows the preferred embodiment o applicant's invention.

Applicant's radio harness 10 has a pair of elasticized strap members 12 of equal length attached in diagonal relationship such that the strap members 12 criss cross at two regions along their lengths 14, 20. The strap members are held in a first overlapping region 14 by threading them through a triangular strap divider 16. The strap members are secured in a second overlapping region 20 by stitching 22. The overall length of each strap member is about 36", although length may vary with the particular size of the wearer. The first overlapping region 14 is close to and equidistant from a first pair of ends 18 of the straps, about 3" (adjustable for different sizes) from this first pair of ends 18. The second overlapping region 20 is closer to and equidistant from the opposite second pair of ends 24, about 12" from this second pair of ends 24. The overlapping regions 14, 20 are spread apart about 20" from one another forming a head-encircling loop.

The first pair of ends 18 are provided with first fasteners 26 and the second pair of ends 24 are provided with complementary second fasteners 28 capable of interlocking with the first fasteners 26.

In applicant's preferred embodiment, each fastener has an opening 30 extending slightly wider than the width of the strap members 12. A strap member 12 is inserted through the opening 30, looped back upon itself and the overlapping portion is sewn by stitching 32 to secure the fastener to the strap member.

The overall length of the strap members may be determined in this manner when manufacturing the radio harness 10. Likewise, length adjustment means such as typically are used with suspenders may be employed so that the length of the strap member is adjustable.

Figure 4:
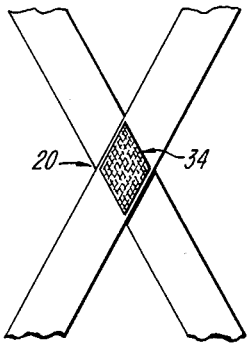
FIG. 4 is an enlarged view of the reverse side of a portion of FIG. 1.

A patch 34 of cut loop material (such as is commonly sold under the trademark Velcro® is sewn to the second overlapping region 20 (FIG. 4). This patch is sewn to the reverse side of the overlapping region 20 shown in FIG. 1 such that it will face the wearer's back when the radio harness is worn.

Figure 5:
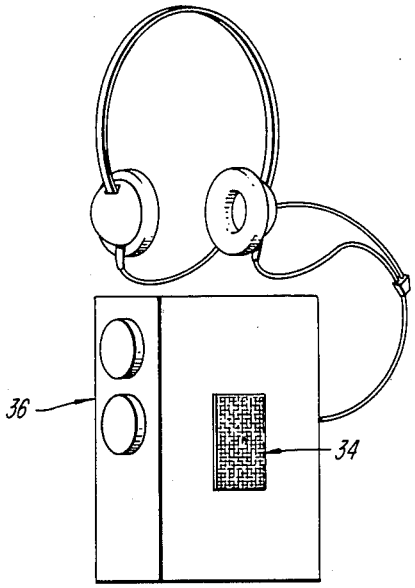
FIG. 5 shows an exemplary radio device capable of being carried by applicant's invention.

Shown in FIG. 5 is a radio device 36. A complementary patch 34 of Velcro®-like material is glued to the radio device 36 so that the radio device 36 may be detachably secured to the radio harness 10.

Figure 2:
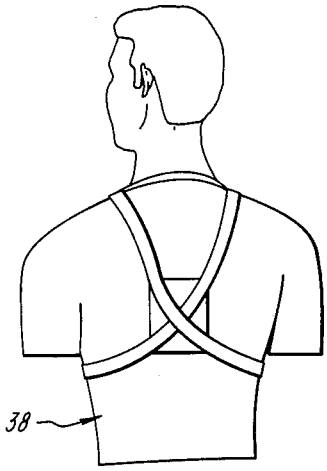
FIG. 2 shows applicant's invention holding a radio against the back of a person.
Figure 3:
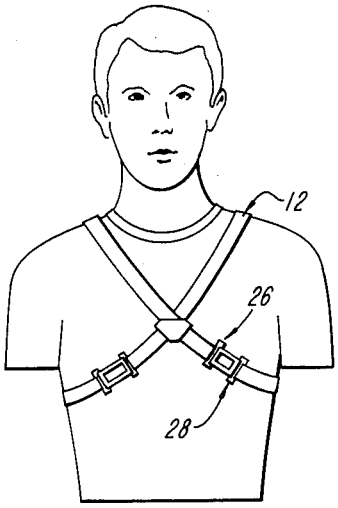
FIG. 3 shows applicant's invention as it appears from the front of a person wearing it.

In use, the head encircling loop is placed over the head of the wearer, the ends of the straps then lying along the wearer's back are brought underneath the wearer's arms to the chest and the complementary ends of the straps are joined by connecting fasteners 26, 28 such that the strap members 12 encircle the wearer's shoulders (FIG. 3). Referring now to FIG. 2, the second overlapping region 20 lies in the center of the back 38 of the wearer between the shoulder blades. The complementary patches 34 of Velcro® hold the radio device 36 to the radio harness 10 with the radio sandwiched between the second overlapping region 20 of the radio harness 10 and the wearer's back 38. The radio device 36 is held in place by the combined action of the Velcro®-like patches 34 and the force exerted by the elasticized strap members 12.

The strap members may be closed loop without detachable fastening means and preferably with length adjustment means. In this instance there are formed two head-encircling loops which are placed over the head of the wearer and the wearer's arms slide through the arm hole-like loops.

It is intended that the radio harness be provided in varying degrees of manufacture in kits. For example, the kit may include the components of the radio harness unassembled. Such a kit would include a pair of elasticized strap members, two pairs of fasteners, and a pair of complementary Velcro®-like patches. Likewise, the kit may include the assembled harness plus a complementary patch of Velcro®-like material capable of being attached to a radio device.

It should be understood that various changes and modifications of the preferred embodiments may be made within the scope of the invention. Thus it is intended that all matter contained in the above description shall be interpreted in an illustrative and not limiting sense.

What I claim is:

1. A device for carrying an article such as a radio while walking, jogging, cycling or the like, the combination comprising, said article, an elasticized harness constructed and arranged to be worn under tension on the upper torso of a person so that a portion of said harness will press against a person's back, said harness comprising a pair of elasticized members of equal length, said elasticized members attached in diagonal relation so as to overlap along a region defining said portion of said harness, and means carried by said portion for attaching said article to said portion, said attachment means constructed and arranged such that said article when attached may be positioned between said portion and a person's back and whereby said harness and attachment means are further constructed and arranged such that said article may be held in place by the combined action of said tension and said attachment means.

2. The combination as claimed in claim 1 wherein said attachment means is a patch of cut-loop material for mating with a complementary patch of cut-loop material on said article.

3. The combination as claimed in claim 1 wherein said attachment means is a patch of cut-loop material for mating with a complementary patch of cut-loop material on said article.

4. The combination as claimed in claim 3 wherein said elasticized members are further attached in diagonal relation so as to overlap along a second region spaced from said first region to form a head-encircling loop.

5. The combination as claimed in claim 1 wherein said elasticized members comprise a pair of straps, each of said straps having a first end and a second end, said first ends having first fastening means and said second ends having second fastening means complementary with said first fastening means.

6. The combination as claimed in claim 5 wherein said attachment means is a patch of cut-loop material for mating with a complementary patch of cut-loop material on said article.

7. The combination as claimed in claim 6 wherein said straps are further attached in diagonal relation so as to overlap along a second region spaced from said first region to form a head-encircling loop.

8. A device for carrying an article such as a radio while walking, jogging, cycling or the like comprising:

a pair of elasticized strap members of equal length, each of said strap members having a first and a second end, said first ends having first fastening means and said second ends having second fastening means, said strap members attached in diagonal relation so as to overlap along a region, said overlapping region being equidistant from said first ends, and said overlapping region spaced from said first ends such that it may be positioned on a person's back when the device is worn, and said elasticized straps constructed and arranged to be worn under tension on an upper torso of a person so that said overlapping portion will press against a person's back, and means on or near said flat-lying overlapping region for attaching said article to said harness, said attachment means constructed and arranged such that said article when attached may be positioned between said flat-lying overlapping region and a person's back and whereby said article may be held in place by the combined action of the attachment means and the tension exerted by the elasticized strap members.

* * * * *